US010774701B2

(12) United States Patent
Mori et al.

(10) Patent No.: US 10,774,701 B2
(45) Date of Patent: Sep. 15, 2020

(54) INTERNAL COMBUSTION ENGINE

(71) Applicant: HONDA MOTOR CO., LTD., Minato-Ku, Tokyo (JP)

(72) Inventors: Kensuke Mori, Wako (JP); Yoshitaka Nukada, Wako (JP); Hiroshi Yokota, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/449,920

(22) Filed: Jun. 24, 2019

(65) Prior Publication Data

US 2020/0011217 A1 Jan. 9, 2020

(30) Foreign Application Priority Data

Jul. 6, 2018 (JP) ..... 2018-129359

(51) Int. Cl.
*F01M 1/10* (2006.01)
*F02F 7/00* (2006.01)
(Continued)

(52) U.S. Cl.
CPC ..... *F01M 1/10* (2013.01); *F01M 1/02* (2013.01); *F01M 5/002* (2013.01); *F01M 11/02* (2013.01); *F02F 7/0021* (2013.01); *F01M 2001/105* (2013.01); *F01M 2011/028* (2013.01); *F01P 3/00* (2013.01)

(58) Field of Classification Search
CPC ..... F01M 1/10; F01M 1/02; F01M 5/002; F01M 11/02; F01M 2001/105; F01M 2011/028; F02F 7/0021; F01P 3/00
See application file for complete search history.

(56) References Cited

U.S. PATENT DOCUMENTS 4,324,213 A * 4/1982 Kasting ..... B01D 35/12 123/196 A
7,516,727 B2 * 4/2009 Ueshima ..... F01M 5/002 123/195 R
(Continued)

FOREIGN PATENT DOCUMENTS

CN 203175641 U 9/2013
JP S57-183509 A 11/1982
(Continued)

OTHER PUBLICATIONS

Official Communication dated Dec. 25, 2019 issued in the corresponding Japanese Office Action 2018-129359 with the English translation thereof.

*Primary Examiner* — Syed O Hasan
(74) *Attorney, Agent, or Firm* — Carrier Blackman & Associates, P.C.; Joseph P. Carrier; William D. Blackman

(57) ABSTRACT

An internal combustion engine includes: an oil filter that is mounted to a mounting surface formed on a crankcase and clarifies an oil flowing in; an oil cooler that is disposed on a front side of the crankcase, cools the oil flowing in from the oil filter and returns the oil into a flow path in the crankcase; and a bracket formed on a front wall of the crankcase and having the mounting surface. An outflow port through which the oil flows out toward the oil cooler and an inflow port through which the oil flows in from the oil cooler are disposed in the bracket. Accordingly, in the internal combustion engine, routes of oil passages can be simplified as much as possible.

5 Claims, 11 Drawing Sheets

(51) Int. Cl.

| | |
|---|---|
| ***F01M 1/02*** | (2006.01) |
| ***F01M 5/00*** | (2006.01) |
| ***F01M 11/02*** | (2006.01) |
| *F01P 3/00* | (2006.01) |

(56) References Cited

U.S. PATENT DOCUMENTS

| | | | | |
|---|---|---|---|---|
| 7,621,251 | B1 | 11/2009 | Courant et al. | |
| 2005/0023200 | A1* | 2/2005 | Ueshima ..... | F01M 5/002<br>210/167.06 |

FOREIGN PATENT DOCUMENTS

| | | | |
|---|---|---|---|
| JP | 563-83411 | U | 6/1988 |
| JP | H10-54218 | A | 2/1998 |
| JP | H11-117807 | A | 4/1999 |
| JP | 2003-035117 | A | 2/2003 |
| JP | 2006-097613 | A | 4/2006 |
| JP | 2006-152832 | A | 6/2006 |
| JP | 2010-064706 | A | 3/2010 |
| JP | 2010-065667 | A | 3/2010 |
| JP | 2017-081333 | A | 5/2017 |
| JP | 2017-082642 | A | 5/2017 |
| KR | 10-0508879 | B | 8/2005 |

* cited by examiner

INTERNAL COMBUSTION ENGINE

BACKGROUND OF THE INVENTION

Field of the Invention

The present invention relates to an internal combustion engine comprising: a crankcase; an oil filter that is mounted to a mounting surface formed on the crankcase and clarifies an oil flowing in; and an oil cooler that is disposed on a front side of the crankcase, cools the oil flowing in from the oil filter and returns the oil into a flow path in the crankcase.

Description of the Related Art

Japanese Patent Application Laid-open No. 2006-97613 discloses an internal combustion engine having an oil filter mounted to a mounting surface of a crankcase. The mounting surface is formed at a bottom plate of the crankcase on the front side of an oil pan. The oil filter is mounted to the mounting surface from below.

An oil cooler is disposed on the front side of the crankcase. An outflow port through which an oil flows out toward the oil cooler and an inflow port through which the oil flows in from the oil cooler are disposed at a front wall of the crankcase. Since the outflow port and the inflow port for the oil are disposed at a distance from the oil filter, the routes of oil passages would be complicated. Attendant on the complication of the routes of the oil passages, the number of working steps at the time of manufacturing the crankcase would be increased.

SUMMARY OF THE INVENTION

The present invention has been accomplished in light of the above circumstances, and it is an object thereof to provide an internal combustion engine in which the routes of oil passages can be simplified as much as possible.

According to a first aspect of the present invention, there is provided an internal combustion engine comprising: a crankcase; an oil filter that is mounted to a mounting surface formed on the crankcase and clarifies an oil flowing in; and an oil cooler that is disposed on a front side of the crankcase, cools the oil flowing in from the oil filter and returns the oil into a flow path in the crankcase, wherein the internal combustion engine further comprises a bracket formed on a front wall of the crankcase and having the mounting surface, and an outflow port through which the oil flows out toward the oil cooler and an inflow port through which the oil flows in from the oil cooler are disposed in the bracket.

In accordance with the first aspect, the oil passages interconnecting the crankcase and the oil cooler are concentratedly disposed in the bracket, and, therefore, the routes of the oil passages can be simplified. At the time of forming the crankcase, the number of working steps in processing the oil passages can be reduced as much as possible.

According to a second aspect of the present invention, in addition to the first aspect, the bracket has the mounting surface receiving the oil filter that protrudes forward from the front wall of the crankcase, the oil filter being attached and detached in an up-down direction.

In accordance with the second aspect, interference between the oil filter and the oil cooler can be avoided, as compared to the case where the oil filter is attached to and detached from the mounting surface formed at the front wall of the crankcase, in the front-rear direction. Maintainability such as replacement of the oil filter can be secured to be good.

According to a third aspect of the present invention, in addition to the first or second aspect, there is provided the internal combustion engine, further comprising a casing that is formed at the front wall of the crankcase and accommodates a balancer operatively connected with rotation of a crankshaft, and the casing protrudes from the front wall of the crankcase in parallel to the oil filter.

In accordance with the third aspect, the oil filter and the casing are arranged in parallel to each other on the front side of the crankcase, and, therefore, the internal combustion engine is reduced in size in the front-rear direction.

According to a fourth aspect of the present invention, in addition to the third aspect, the crankcase is provided with a branch oil passage that is branched from an oil passage extending from the oil filter toward the outflow port, the branch oil passage supplying the oil to the balancer.

In accordance with the fourth aspect, the supply of the oil to the balancer can be realized through a short oil passage from the oil filter.

According to a fifth aspect of the present invention, in addition to the first or second aspect, the oil cooler is disposed under a radiator, and has a first port communicating with the outflow port and a second port communicating with the inflow port, between a first horizontal plane making contact with the oil filter from above and a second horizontal plane making contact with the oil filter from below.

In accordance with the fifth aspect, the piping interconnecting the crankcase and the oil cooler can be shortened as much as possible.

According to a sixth aspect of the present invention, in addition to the first or second aspect, the oil filter is located within a transverse width of the oil cooler as seen in front view, and part of the oil filter is located within an up-down width of the oil cooler as seen in front view.

In accordance with the sixth aspect, when the internal combustion engine is mounted on a two-wheeled motor vehicle, the influence of flying stones and the like coming from the front side on the oil filter during traveling of the two-wheeled motor vehicle can be reduced.

According to a seventh aspect of the present invention, in addition to the first or second aspect, the flow path includes: a main gallery that extends in parallel to a rotational axis of a crankshaft and apportions the oil in the crankcase; a first linear oil passage that is connected to the inflow port and extends linearly from an outer surface of the bracket to intersect the main gallery; and a second linear oil passage that is connected to an oil pump, extends linearly in parallel to the first linear oil passage, and opens into the oil filter.

In accordance with the seventh aspect, the first linear oil passage and the second linear oil passage are concentratedly disposed in the periphery of the oil filter. Therefore, a processing work is made efficient, and productivity is enhanced. Especially, since the first linear oil passage and the second linear oil passage extend in parallel to each other, the processing work can be realized from the same direction, and the working process can be made more efficient.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described below, referring to the attached drawings. Here, the directions of up, down, front, rear, left and right of a vehicle body are to be defined based on the gaze of a rider riding a two-wheeled motor vehicle.

Figure 1:
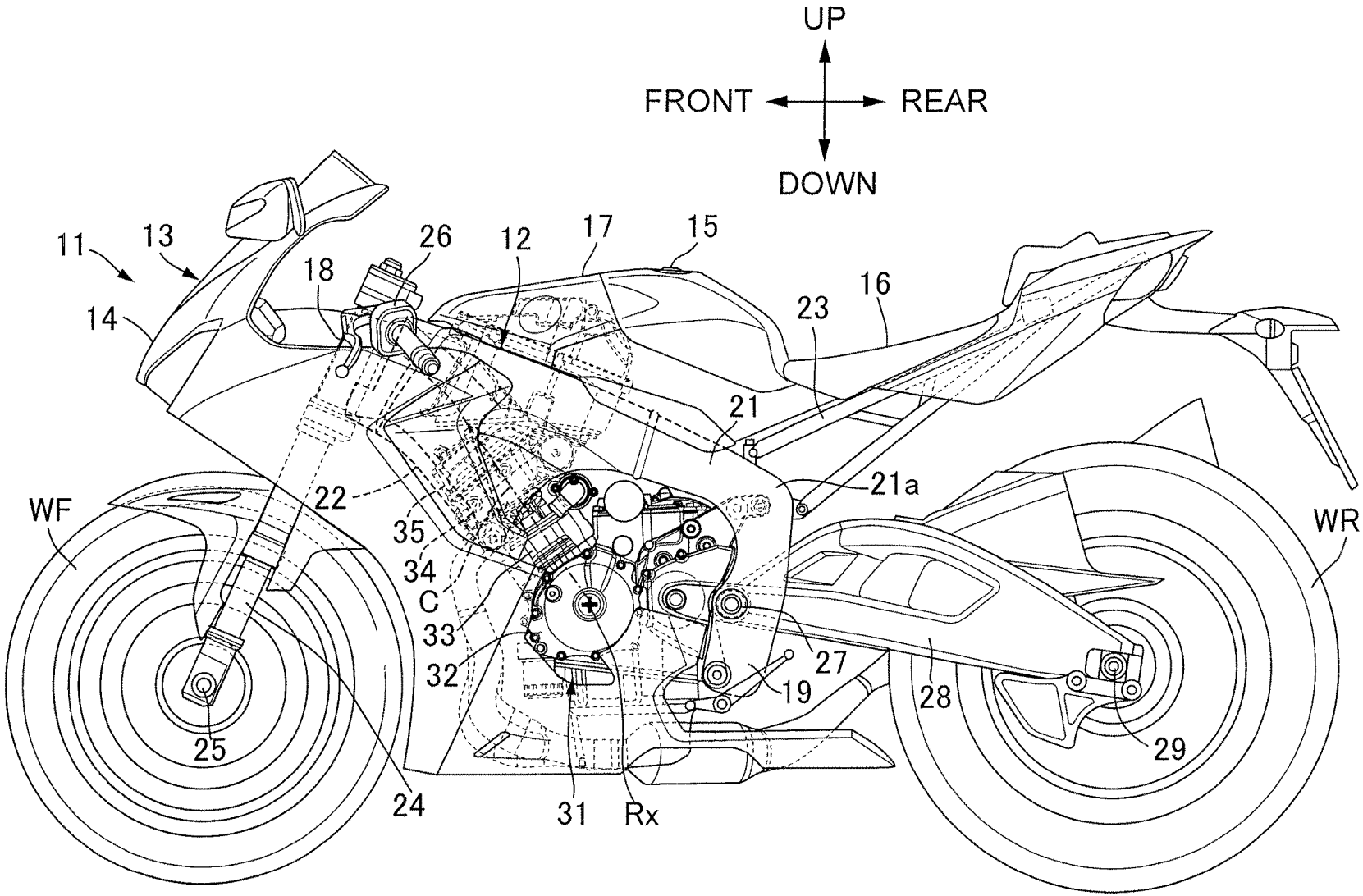
FIG. 1 is a side view schematically depicting a whole configuration of a two-wheeled motor vehicle according to an embodiment of the present invention.

FIG. 1 denotes schematically a whole image of a two-wheeled motor vehicle which is a saddle type vehicle according to an embodiment of the present invention. A two-wheeled motor vehicle 11 includes a body frame 12, and a body cover 13 mounted to the body frame 12. The body cover 13 includes a front cowl 14 covering the body frame 12 from the front side, and a tank cover 17 which continues forward from an outer surface of a fuel tank 15 and is connected to a rider seat 16 on the rear side of the fuel tank 15. A fuel is reserved in the fuel tank 15. The rider straddles the rider seat 16 when driving the two-wheeled motor vehicle 11.

The body frame 12 includes: a head pipe 18; a pair of left and right main frames 21 that extend rearwardly downward from the head pipe 18 and have pivot frames 19 at rear lower ends thereof; a down frame 22 that extends downward from the head pipe 18 at a position under the main frames 21 and is united to the main frames 21; and left and right seat frames 23 that extend rearwardly upward from curved regions 21*a* of the main frames 21 and constitute a truss structure. The rider seat 16 is supported on the seat frames 23.

A front fork 24 is steerably supported on the head pipe 18. A front wheel WF is supported on the front fork 24 such as to be rotatable around an axle 25. A steering handlebar 26 is connected to an upper end of the front fork 24. When driving the two-wheeled motor vehicle 11, the driver holds grips at left and right ends of the steering handlebar 26.

A swing arm 28 is linked to the body frame 12 on the rear side in the vehicle, such as to be swingable in the up-down direction around a pivot 27. A rear wheel WR is supported on a rear end of the swing arm 28 such as to be rotatable around an axle 29. An internal combustion engine 31 producing a driving force that is to be transmitted to the rear wheel WR is mounted on the body frame 12 between the front wheel WF and the rear wheel WR. The internal combustion engine 31 is supported in the state of being linked to the down frame 22 and the main frames 21. Power of the internal combustion engine 31 is transmitted to the rear wheel WR through a transmission device.

Figure 2:
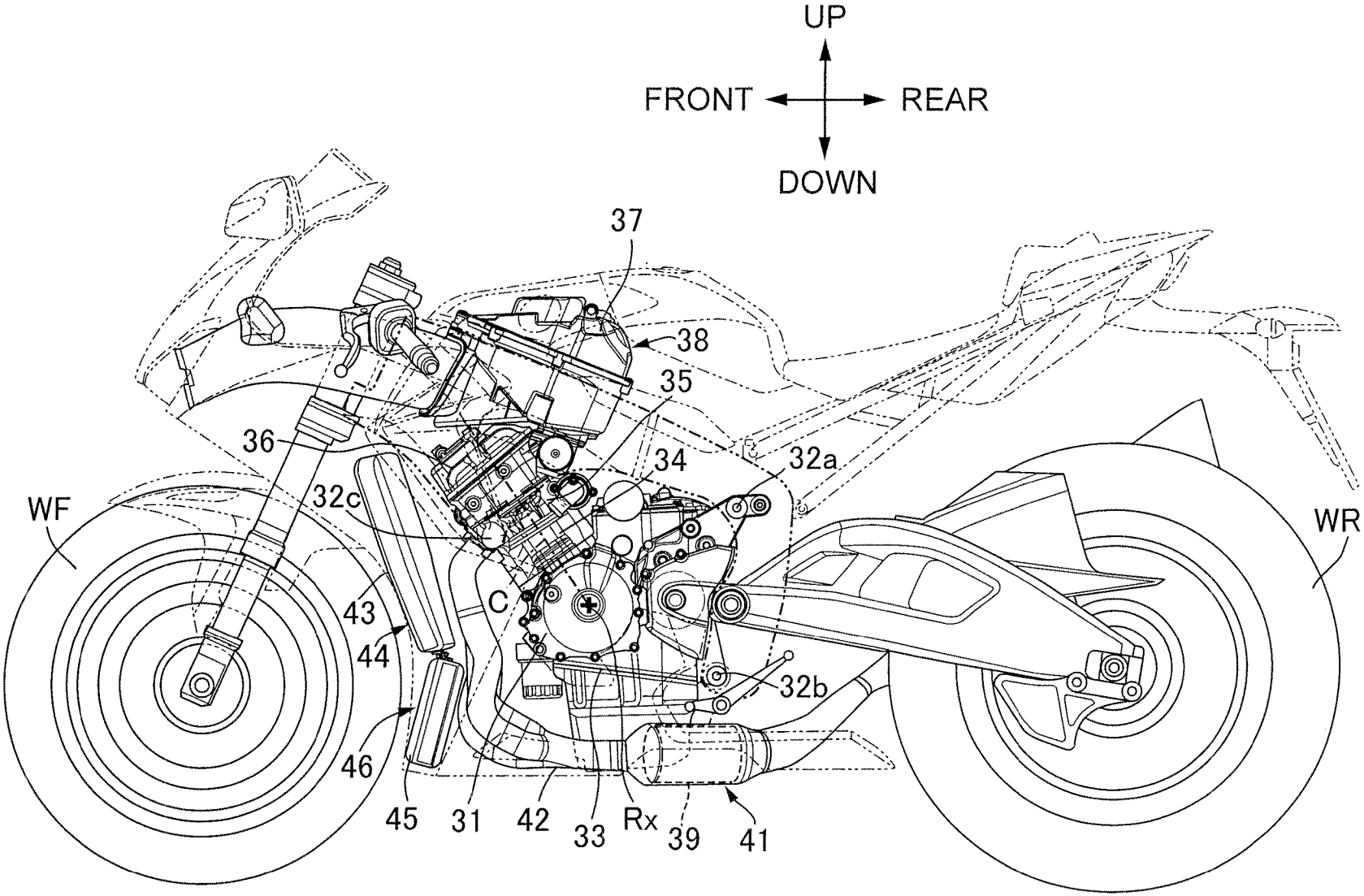
FIG. 2 is a side view schematically depicting the whole configuration of the two-wheeled motor vehicle in a state in which a body cover has been detached.

As depicted in FIG. 2, an engine main body of the internal combustion engine 31 includes a crankcase 33 that has, at an upper end and a lower end of a rear wall, internal combustion engine hangers 32*a* and 32*b* linked to the main frames 21 and outputs the power around a rotational axis Rx; a cylinder block 34 that is connected to a front portion of the crankcase 33 from above and has a cylinder axis C located in a vertical plane orthogonal to the rotational axis Rx and rising relative to a horizontal plane; a cylinder head 35 that is connected to an upper end of the cylinder block 34, has at a front wall an internal combustion engine hanger 32*c* linked to the down frame 22, and support a valve train; and a head cover 36 that is connected to an upper end of the cylinder head 35 and covers the valve train over the cylinder head 35.

An intake system 38 that sprays fuel to air clarified by an air cleaner 37 to form an air-fuel mixture and supplies the air-fuel mixture into a combustion chamber covered by the cylinder head 35, and an exhaust system 41 that clarifies, by a catalyst 39, an exhaust gas after combustion discharged from the combustion chamber and discharges the exhaust gas to the rear side of the vehicle body while lowering the temperature of the exhaust gas, are connected to the cylinder head 35. The exhaust system 41 has an exhaust pipe 42 which extends under the crankcase 33 along a lateral side of the rear wheel WR and supports the catalyst 39 under the crankcase 33.

Figure 3:
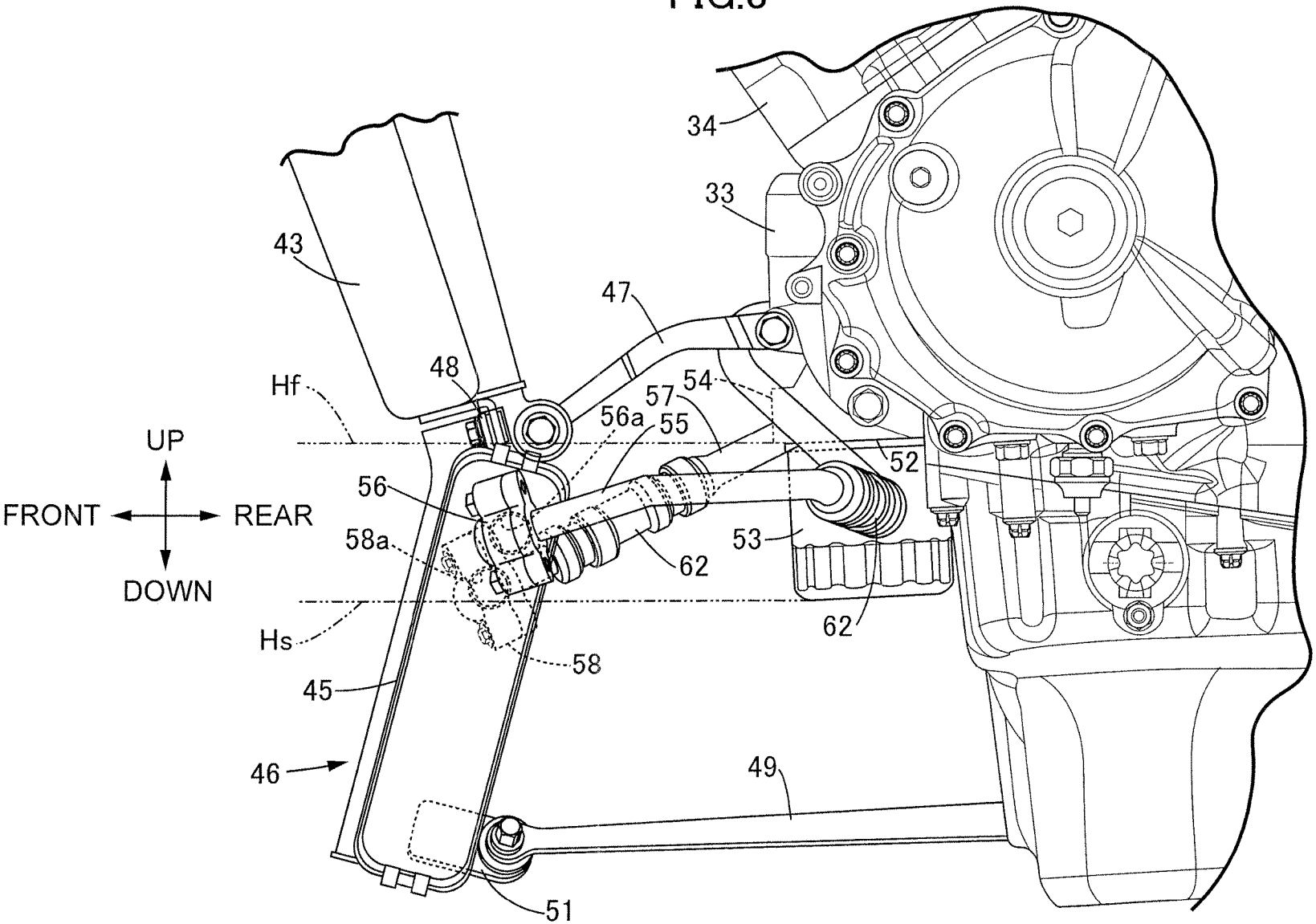
FIG. 3 is an enlarged partial side view of an internal combustion engine including an oil cooler.

The internal combustion engine 31 includes: a cooling device 44 that causes cooling water to flow between a radiator 43 disposed on the front side of the cylinder block 34 and a water jacket in the engine main body to realize cooling of the engine main body; and an oil circulation device 46 that causes an engine oil to flow between an oil cooler 45 disposed on the front side of the crankcase 33 and linked to a lower end of the radiator 43 and a flow path in the engine main body, so as to realize cooling of the engine oil. An upper end of the radiator 43 is fastened to the down frame 22. As depicted in FIG. 3, a lower end of the radiator 43 is linked to a front wall of the crankcase 33 by a first stay 47. An attachment piece 48 fastened to the lower end of the radiator 43 is fixed to an upper end of the oil cooler 45. An attachment piece 51 fastened to a front end of a second stay 49 extending from the front wall of the crankcase 33 is fixed to a lower end of the oil cooler 45.

The oil circulation device 46 includes an oil filter 53 that is mounted from below to a mounting surface 52 formed on the crankcase 33 and clarifies the engine oil flowing in. The oil filter 53 has a filter element accommodated in a cylindrical container having a center axis extending in the vertical direction. The mounting surface 52 for the oil filter 53 is formed in a downward orientation on a bracket 54 protruding from the front wall of the crankcase 33. The oil filter 53 is attached to and detached from the bracket 54 in the up-down direction.

The oil cooler 45 includes: a first joint 56 that is connected to a first connection pipe 55 extending from the front wall of the crankcase 33 and has a first port 56*a* for accepting the engine oil flowing out of the crankcase 33; and a second joint 58 that is connected to a second connection pipe 57 extending from the front wall of the crankcase 33 and has a second port 58*a* through which the engine oil flows out toward the crankcase 33. The first port 56*a* and the second port 58*a* are disposed between a first horizontal plane Hf making contact with the oil filter 53 from above and a second horizontal plane Hs making contact with the oil filter 53 from below. The oil cooler 45 cools the engine oil flowing in from the oil filter 53 and returns the engine oil into an oil passage in the crankcase 33.

Figure 4:
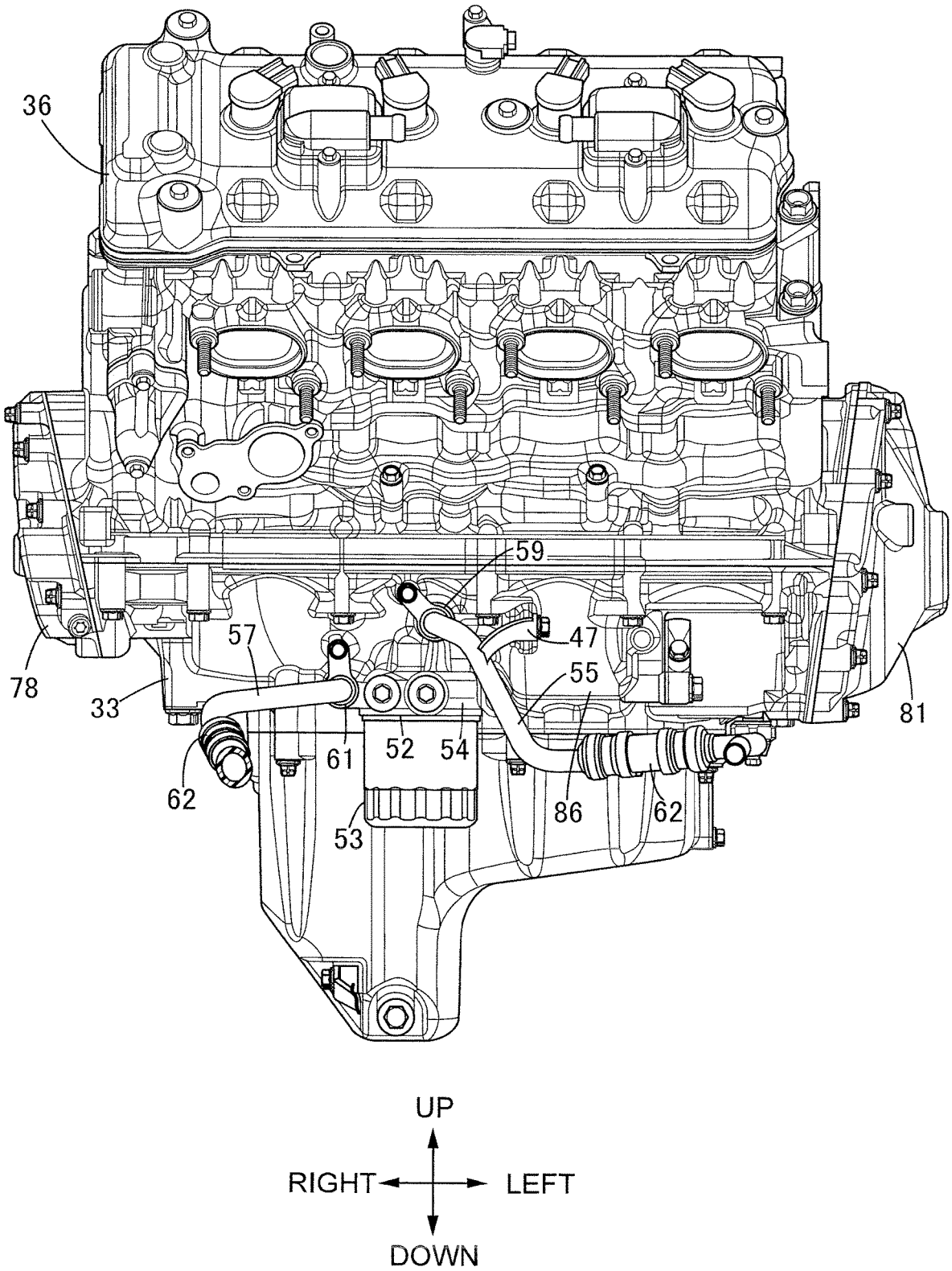
FIG. 4 is an enlarged front view of an engine main body.

As illustrated in FIG. 4, an outflow port 59 which is connected to the first connection pipe 55 and through which the engine oil flows out toward the oil cooler 45 and an inflow port 61 which is connected to the second connection pipe 57 and through which the engine oil flows in from the oil cooler 45 are disposed in the bracket 54. Here, the bracket 54 includes a bulging part where the mounting surface 52 is formed, and a part which is continuous with the bulging part and protrudes from the front wall of the crankcase 33.

Figure 5:
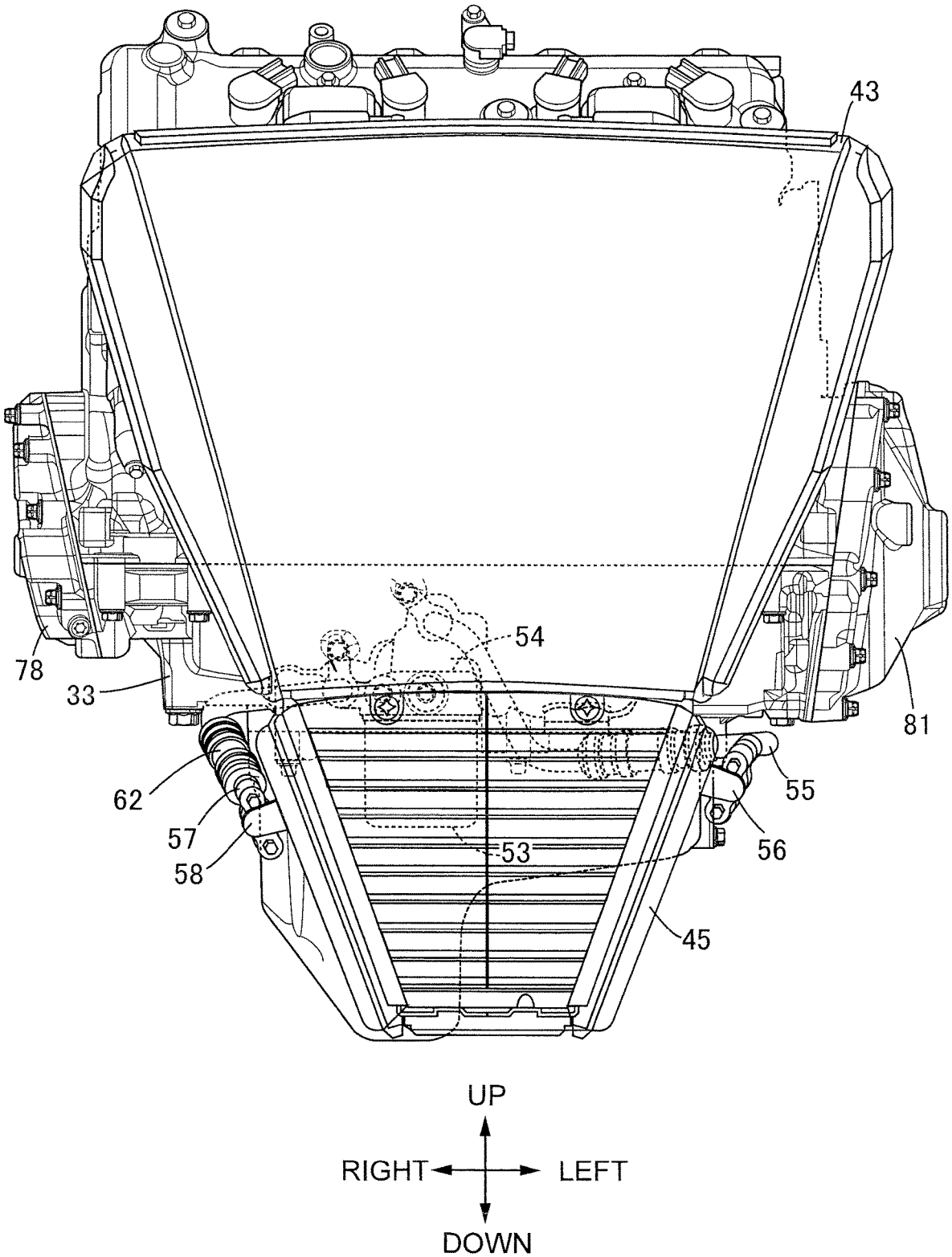
FIG. 5 is an enlarged front view of the internal combustion engine including a radiator and the oil cooler.

The first connection pipe 55 and the second connection pipe 57 are formed by using a metallic pipe extending in a combination of the transverse vehicle direction and the longitudinal vehicle direction while bending at at least two locations, and a flexible rubber-made connection tube 62 incorporated at an intermediate point in the metallic pipe. The connection tube 62 absorbs positional deviations of the first port 56*a* and the second port 58*a* of the oil cooler 45 in relation to the outflow port 59 and the inflow port 61 of the crankcase 33. As depicted in FIG. 5, as seen in front view, the oil filter 53 is located within the transverse width of the oil cooler 45, and part of the oil filter 53 is located within the up-down width of the oil cooler 45. The radiator 43 and the oil cooler 45 are disposed on the front side of the oil filter 53. As seen in front view, the radiator 43 and the oil cooler 45 hide the oil filter 53.

Figure 6:
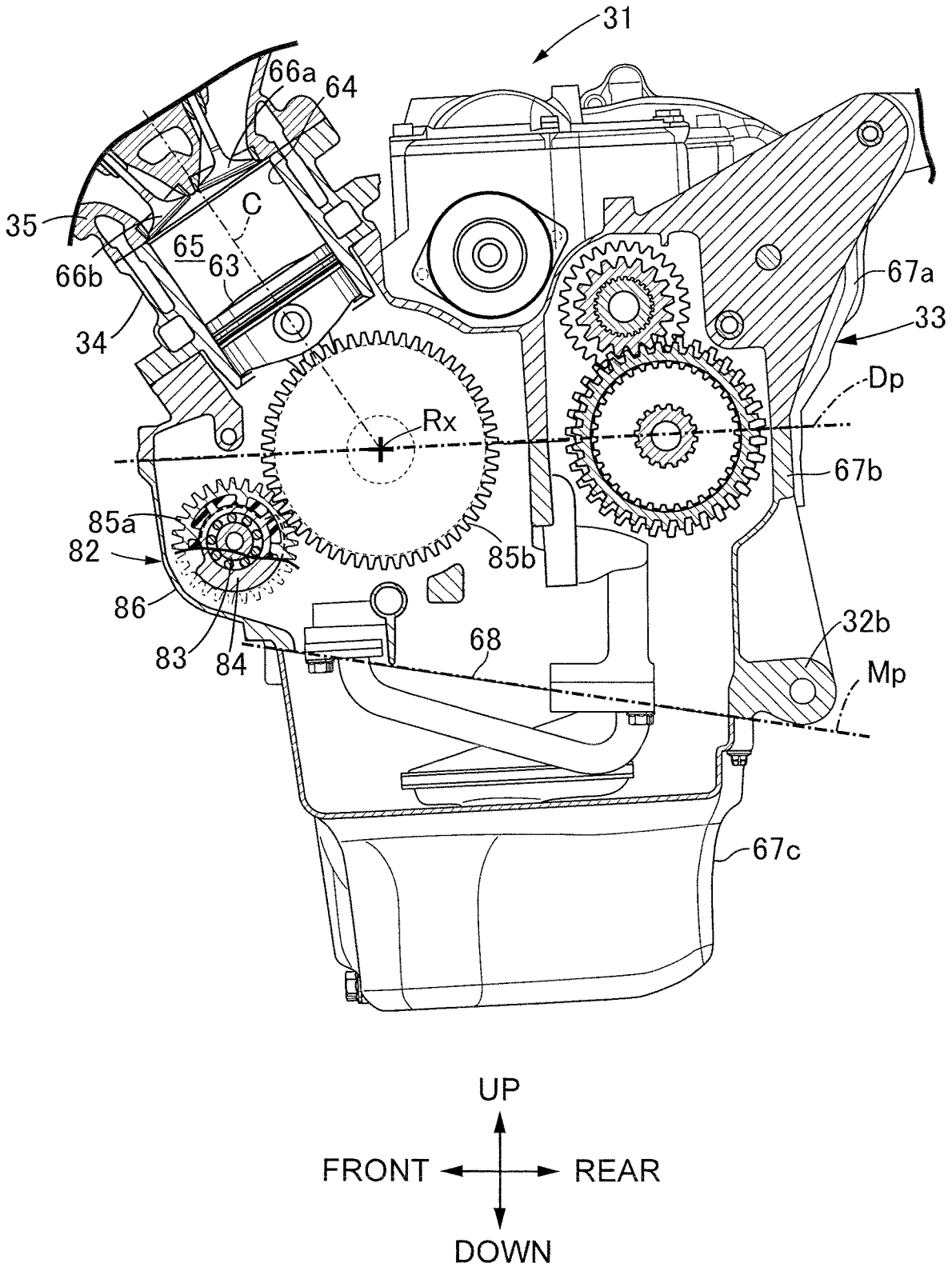
FIG. 6 is an enlarged vertical sectional view of the engine main body as observed in a section orthogonal to a rotational axis of a secondary balancer.

As depicted in FIG. 6, the cylinder block 34 is formed therein with cylinders 64 each of which guides a linear reciprocating motion of a piston 63 along the cylinder axis C. Here, the internal combustion engine 31 is a so-called in-line four-cylinder engine in which four cylinders 64 are arranged along the rotational axis Rx in the cylinder block 34. A combustion chamber 65 is defined between the piston 63 and the cylinder head 35. By the functions of an intake valve 66*a* and an exhaust valve 66*b* opened and closed according to rotation of a camshaft, an air-fuel mixture is introduced into the combustion chamber 65 and an exhaust gas after combustion is discharged from the combustion chamber 65.

The crankcase 33 includes an upper body 67*a* and a lower body 67*b* split at a split surface defined in a horizontal plane Dp, and an oil pan 67*c* connected from below to the lower body 67*b* at a mating surface 68 defined in an imaginary plane Mp intersecting the horizontal plane Dp, which contains the split surface, at a predetermined inclination angle. An intersection between the imaginary plane Mp and the horizontal plane Dp is set in parallel to the rotational axis Rx of a crankshaft. The mating surface 68 is inclined rearwardly downward from a front edge thereof.

Figure 7:
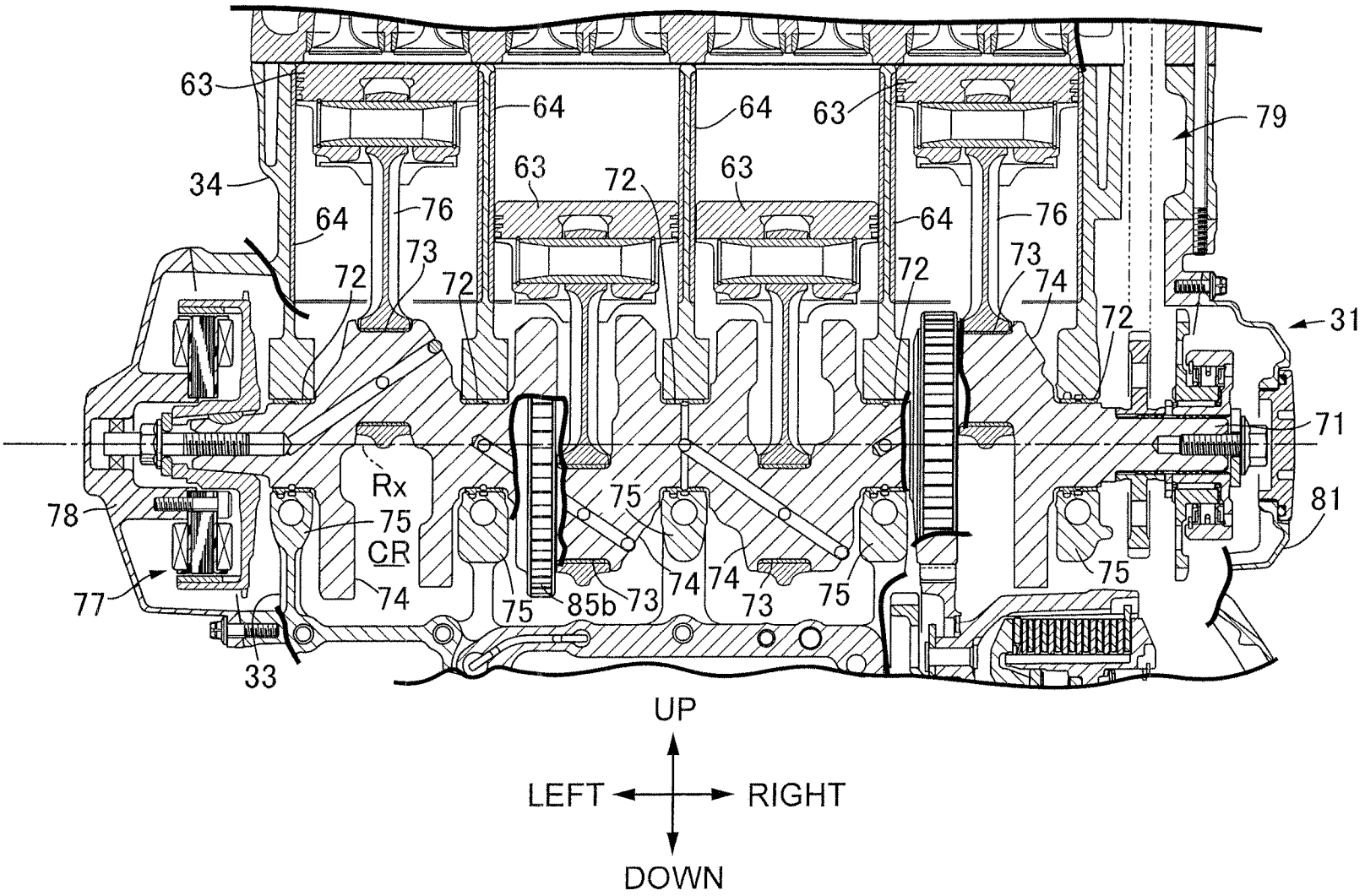
FIG. 7 is an enlarged partial sectional view of the internal combustion engine as observed in a section including a rotational axis of a crankshaft and a cylinder axis.

As illustrated in FIG. 7, the crankshaft 71 is supported on the crankcase 33 such as to be rotatable around the rotational axis Rx. The crankshaft 71 includes journals 72 formed coaxially with the rotational axis Rx, and cranks 74 which are each disposed between the adjacent journals 72 and which each have a crank pin 73 extending in parallel to the rotational axis Rx and interconnecting crank webs. The crankcase 33 is formed with partition walls 75 individually supporting the journals 72 rotatably by plain bearings correspondingly to the individual cylinders 64. A large end portion of a connecting rod 76 extending from the piston 63 is rotatably linked to the crank pin 73. The connecting rod 76 convers the linear reciprocating motion of the piston 63 into a rotational motion of the crankshaft 71.

One end of the crankshaft 71 protrudes to the outside from a left side surface of the crankcase 33. An alternating current generator (ACG) 77 is connected to the one end of the crankshaft 71. An ACG cover 78 for accommodating the ACG 77 between itself and the crankcase 33 is connected to the left side surface of the crankcase 33.

The other end of the crankshaft 71 protrudes to the outside from a right side surface of the crankcase 33. A valve train 79 that transmits power to the camshaft is linked to the other end of the crankshaft 71. A valve train cover 81 for partly accommodating the valve train 79 between itself and the crankcase 33 is connected to the right side surface of the crankcase 33. The ACG cover 78 and the valve train cover 81 cover an outer surface of the crankcase 33 to define a crank chamber CR for accommodating the crankshaft 71.

As depicted in FIG. 6, a secondary balancer 82 disposed on the front side of the crankshaft 71 and operatively connected with the crankshaft 71 is accommodated in the crankcase 33. The secondary balancer 82 includes an eccentric weight 84 supported on a balancer shaft 83 rotatably around an axis parallel to the rotational axis Rx of the crankshaft 71, and a balancer driven gear 85*a* supported on the balancer shaft 83 rotatably coaxially with the eccentric weight 84 and linked to the eccentric weight 84. The balancer driven gear 85*a* may be supported on and fixed to the eccentric weight 84. The balancer driven gear 85*a* is meshed with a driving gear 85*b* fixed to the crankshaft 71. By receiving the driving force of a driving gear 85*b*, the balancer driven gear 85*a* causes rotation of the eccentric weight 84 around the balancer shaft 83. As illustrated in FIG. 7, the driving gear 85*b* is formed to be integral with one of the cranks 74 of the crankshaft 71.

Figure 8:
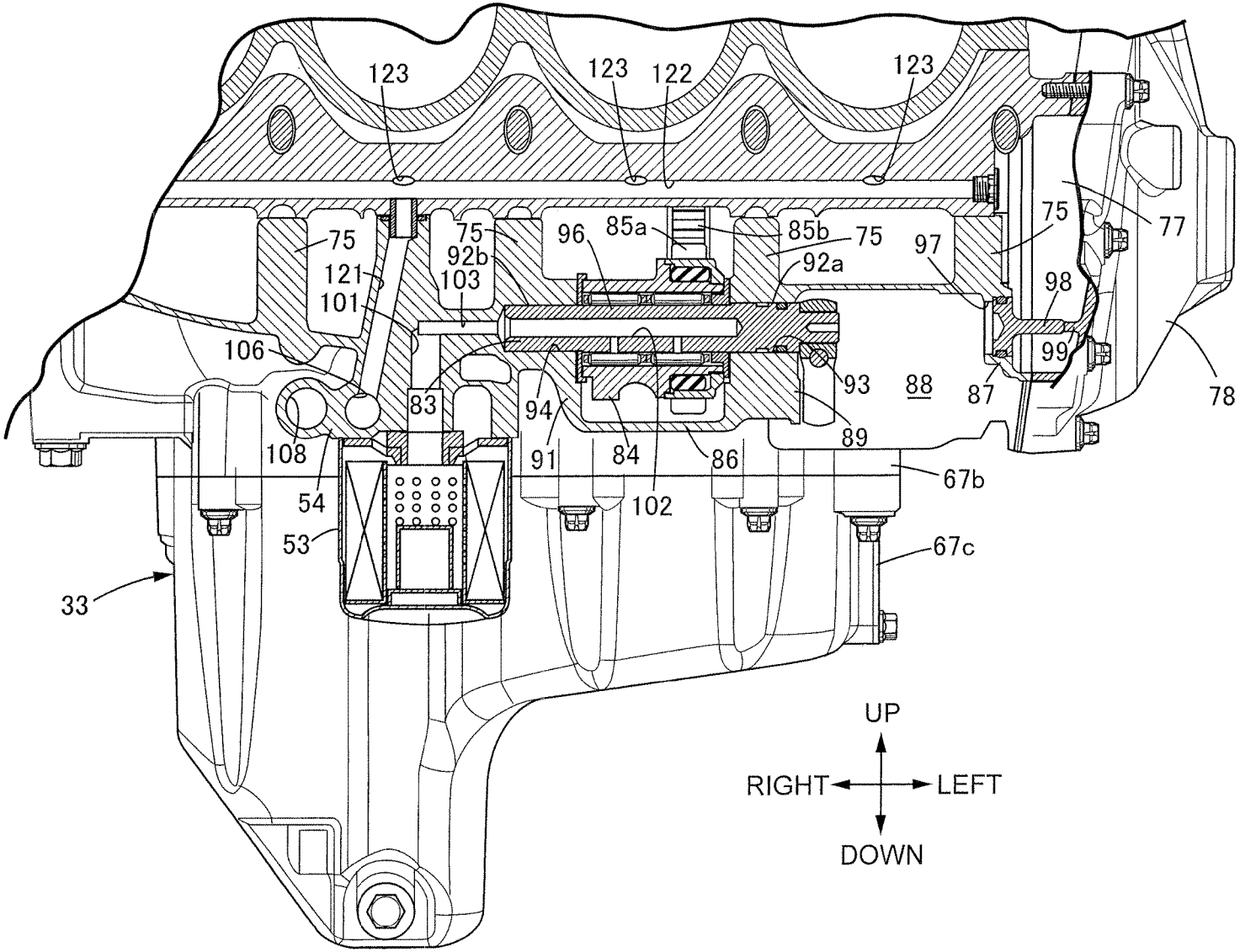
FIG. 8 is an enlarged partial sectional view of the internal combustion engine as observed in a vertical section including a center axis of an oil filter and an axis of a balancer shaft.

As depicted in FIG. 4, the front wall of the crankcase 33 is formed with a casing 86 which defines a space for accommodating the eccentric weight 84 and the balancer driven gear 85*a*, continuously from the crank chamber CR. As illustrated in FIG. 8, the crankcase 33 is formed with a wall body 87 for accommodating the ACG 77 between itself and the ACG cover 78, continuously from the partition walls 75.

The casing 86 includes: a first casing wall 89 that faces the wall body 87 with a space 88 therebetween while contacting the front wall of the crankcase 33, at a position separate from the wall body 87 in the axial direction of the crankshaft 71; and a second casing wall 91 that is faced to the first casing wall 89 with the accommodation space for the eccentric weight 84 and the balancer driven gear 85*a* therebetween. The first casing wall 89 is continuous from the partition wall 75 disposed between the cylinder 64 located on an outer side and the cylinder 64 located on an inner side. The second casing wall 91 is continuous from the partition wall 75 disposed between the cylinders 64 located on the inner side.

The balancer shaft 83 has, at one end and the other end thereof, a first support shaft 92*a* and a second support shaft 92*b* which have an axis parallel to the rotational axis Rx of the crankshaft 71 and eccentric from the rotational axis of the eccentric weight 84. The first support shaft 92*a* is inserted in and supported by a support hole 93 bored in the first casing wall 89. The second support shaft 92*b* is inserted in and supported by a support hole 94 bored in the second casing wall 91.

The one end of the balancer shaft 83 protrudes from the first casing wall 89 into the space 88, and is faced to the wall body 87 at its tip end. The eccentric weight 84 is mounted to an eccentric shaft 96 through a rolling bearing. When the balancer shaft 83 rotates, the balancer driven gear 85*a* can be brought toward and away from the driving gear 85*b* by the function of the eccentric shaft 96. Backlash is controlled between the balancer driven gear 85*a* and the driving gear 85*b*.

The wall body 87 is formed therein with a through-hole 97 having a diameter larger than the outside diameter of the balancer shaft 83, coaxially with the first support shaft 92*a* of the balancer shaft 83. The through-hole 97 has a large diameter portion on the ACG 77 side. A plug member 98 for closing the through-hole 97 is inserted into the large diameter portion of the through-hole 97 in a liquid-tight manner, from outside of the crankcase 33. The generator cover 78 is formed with a retainer 99 that makes contact with the plug member 98 when the generator cover 78 is connected to the crankcase 33 from outside of the crankcase 33.

At the crankcase 33, the bracket 54 is united to the casing 86. The bracket 54 is formed therein with a vertical oil passage 101 (as an oil passage) extending linearly in the vertical direction from the oil filter 53, and a horizontal oil passage 103 (as an oil passage) that extends linearly in a horizontal direction from an upper end of the vertical oil passage 101 and is connected to an in-shaft oil passage 102 coaxially bored in the balancer shaft 83. The engine oil is supplied from the in-shaft oil passage 102 to a rolling bearing on the eccentric shaft 96.

Figure 9:
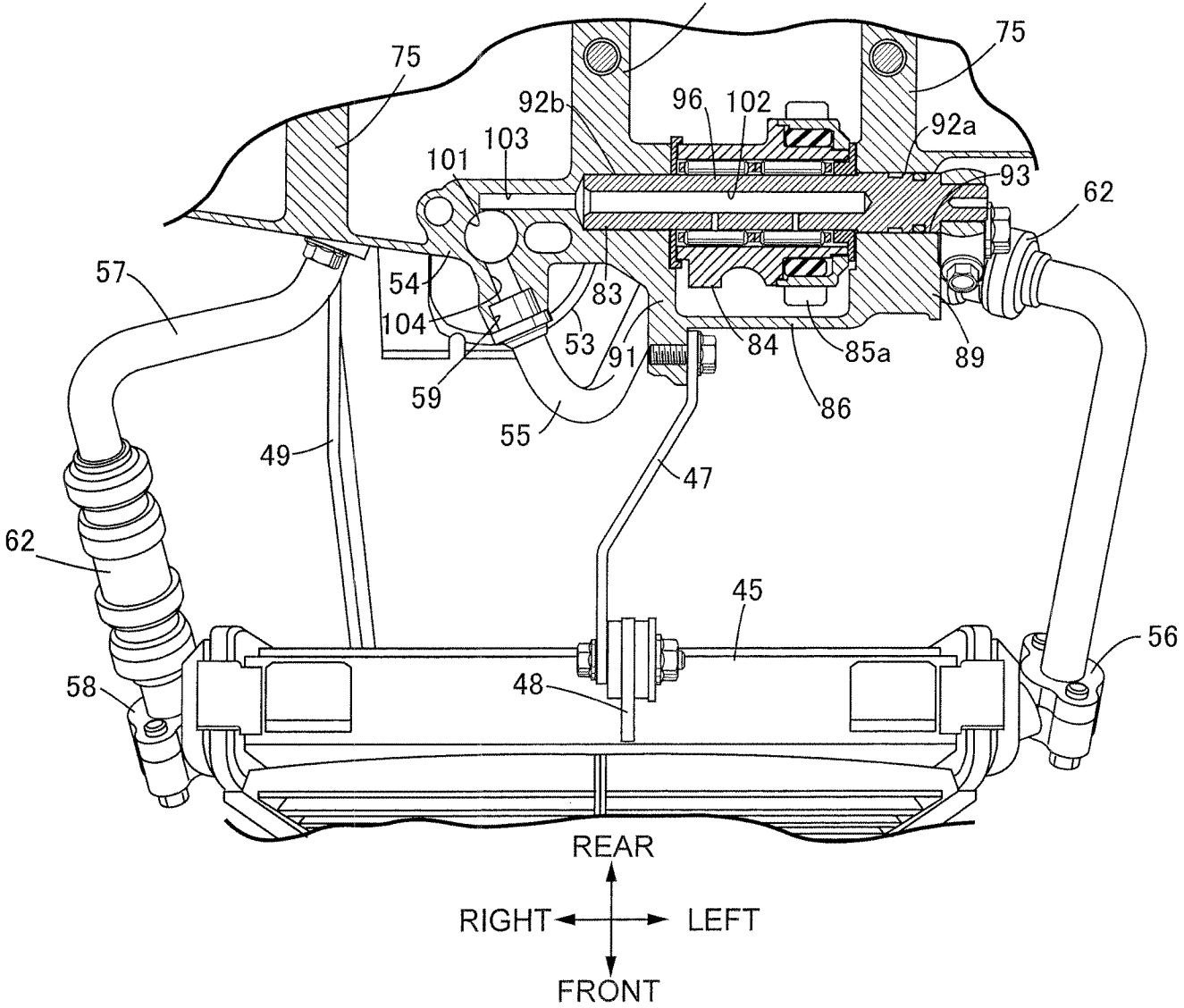
FIG. 9 is an enlarged partial sectional view of the internal combustion engine as observed in a horizontal section including an axis of a balancer shaft.

As illustrated in FIG. 9, in the bracket 54, an outlet oil passage 104 is defined which is connected to the upper end of the vertical oil passage 101, extends linearly, and is connected to the outflow port 59. The vertical oil passage 101 and the outlet oil passage 104 form an oil passage which extends from the oil filter 53 toward the outflow port 59. Therefore, the horizontal oil passage 103 functions as a branch oil passage.

Figure 10:
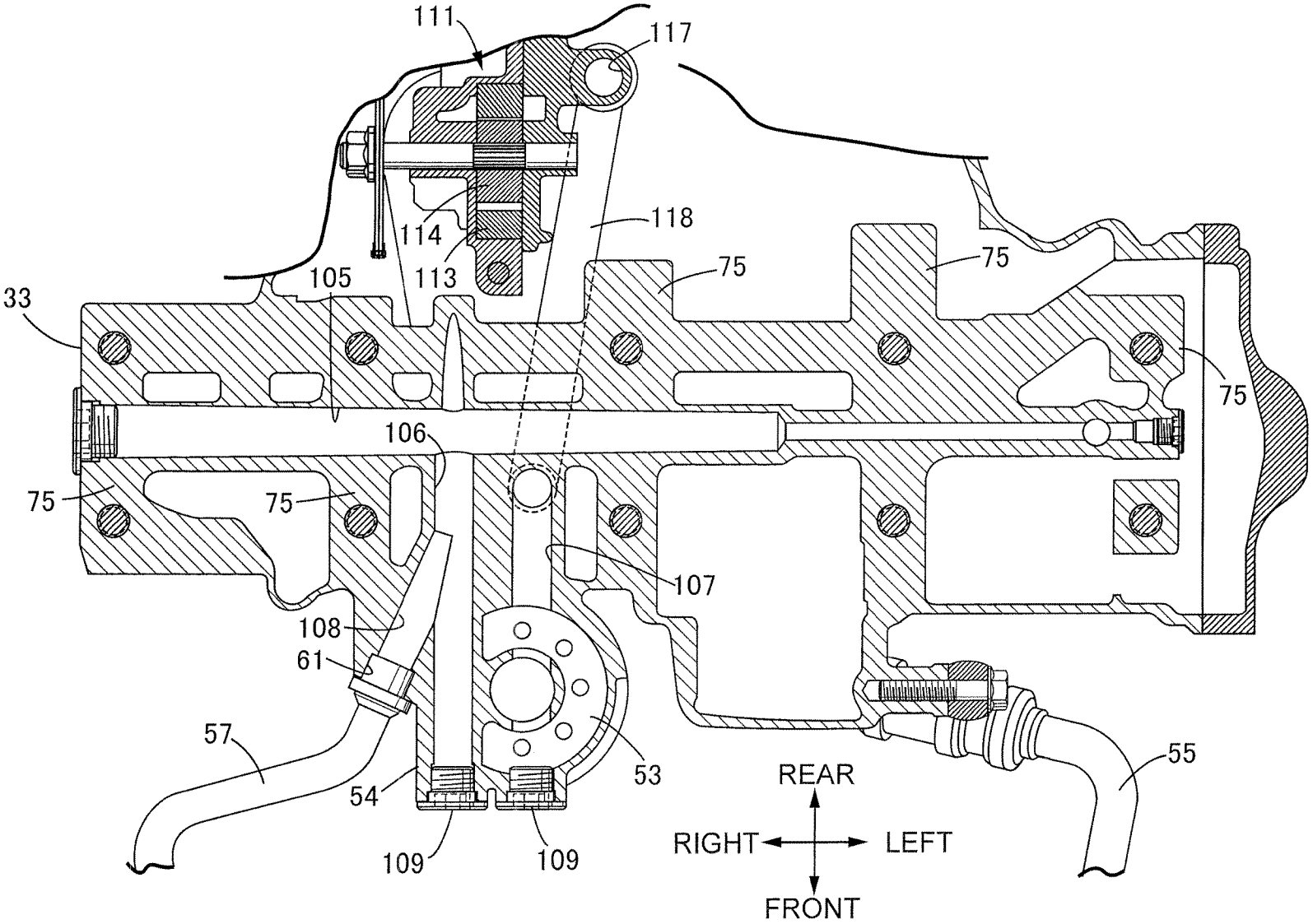
FIG. 10 is an enlarged partial sectional view of the internal combustion engine as observed in a horizontal section including a center axis of a main gallery.

As depicted in FIG. 10, the crankcase 33 is formed therein with a main gallery 105 that extends in parallel to the rotational axis Rx of the crankshaft 71 and penetrates the individual partition walls 75. The bracket 54 is formed therein with a first linear oil passage 106 that extends linearly from an outer surface of the bracket 54 to intersect the main gallery 105, and a second linear oil passage 107 that extends in parallel to the first linear oil passage 106 and opens into the oil filter 53. An inlet oil passage 108 that extends linearly from the outer surface of the bracket 54, intersects the first linear oil passage 106 at a small inclination angle and is connected to the inflow port 61 is connected to the first linear oil passage 106. An opening end (front end) of the first linear oil passage 106 and an opening end (front end) of the second linear oil passage 107 are each closed in a liquid-tight manner by a plug member 109.

Figure 11:
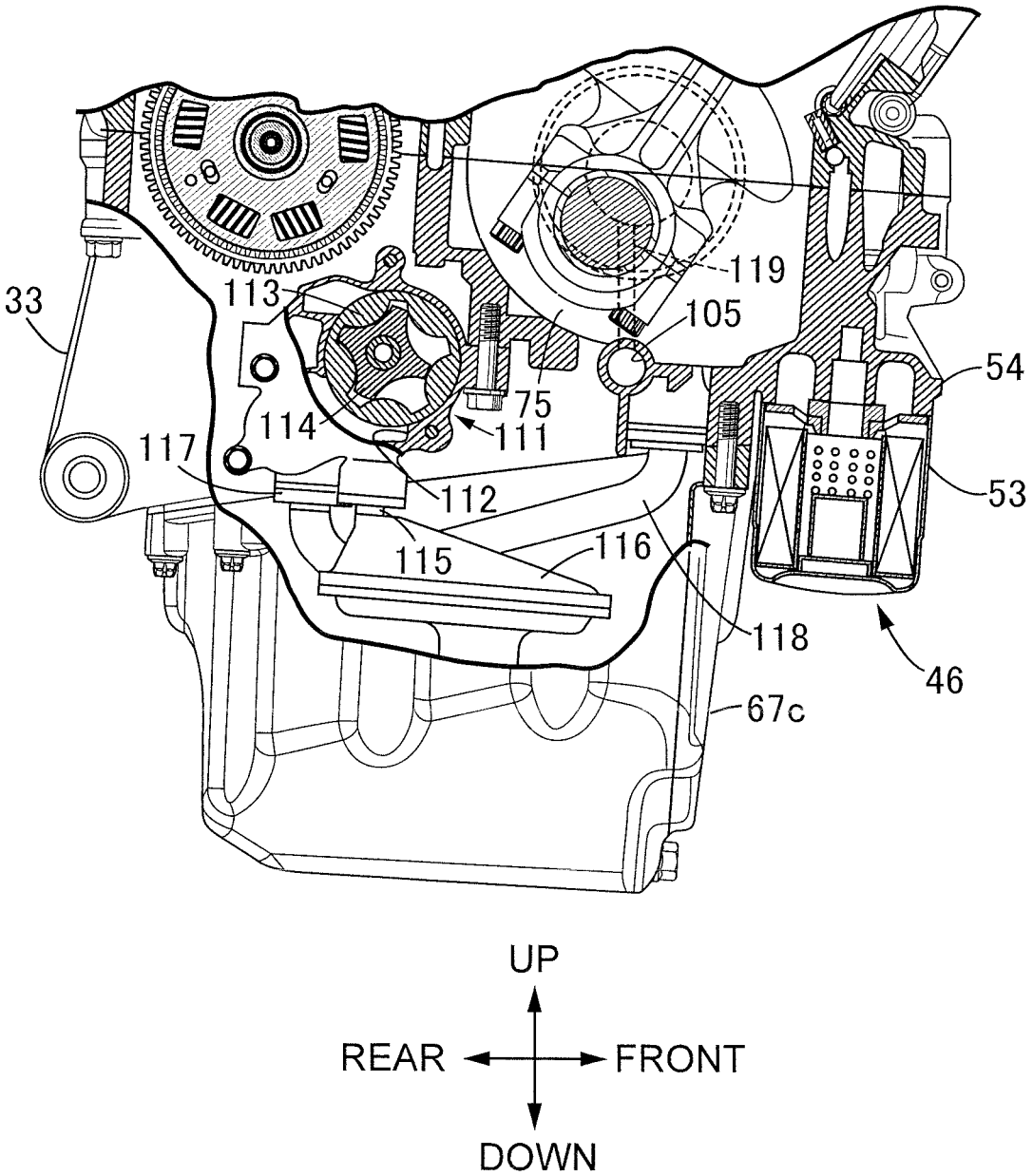
FIG. 11 is an enlarged vertical sectional view of the internal combustion engine as observed in a section orthogonal to a rotational axis of an oil pump.

As illustrated in FIG. 11, the oil circulation device 46 includes an oil pump 111 that is mounted inside the crankcase 33 and is operated in operative connection with the rotation of the crankshaft 71. The oil pump 111 is configured as a trochoid pump. Specifically, the oil pump 111 includes: a pump chamber 112 defining a disk-shaped space having an axis parallel to the rotational axis Rx of the crankshaft 71; an outer rotor 113 that is fitted to the pump chamber 112 such as to be slidable on an inner wall surface of the pump chamber 112 at a cylindrical surface coaxial with the pump chamber 112; and an inner rotor 114 that is disposed inside the outer rotor 113 and is rotated around a rotational axis deviated from a rotational axis of the outer rotor 113.

The oil pump 111 is provided with a downwardly directed suction port 115 for sucking up the engine oil from a lower position of an oil pan 67*c*. A strainer 116 extending to the lower position of the oil pan 67*c* is connected to the suction port 115. When the oil pump 111 operates, the engine oil reserved in the oil pan 67*c* is sucked into the pump chamber 112 via the suction port 115.

The oil pump 111 is provided with a downwardly directed discharge port 117. An oil pipe 118 that extends forwardly upward and is connected to the bracket 54 from inside of the crankcase 33 is connected to the discharge port 117. As depicted in FIG. 10, the second linear oil passage 107 in the bracket 54 is connected to the oil pump 111 through the oil pipe 118.

As illustrated in FIG. 11, each of the partition walls 75 is formed with a supply oil passage 119 rising linearly in the longitudinal direction from the main gallery 105. An upper end of the supply oil passage 119 opens to each plain bearing. In this way, the engine oil is apportioned in the crankcase 33 from the main gallery 105.

As depicted in FIG. 8, the crankcase 33 is formed with a connection oil passage 121 extending linearly in the longitudinal direction from the first linear oil passage 106. An apportioning oil passage 122 extending linearly in parallel to the rotational axis Rx of the crankshaft 71 is connected to an upper end of the connection oil passage 121. The apportioning oil passage 122 is formed with piston oil jets 123 on the basis of each of the cylinders 64. The engine oil is jetted from the piston oil jets 123 to the pistons 63 in the cylinders 64.

An operation of the present embodiment will be described below. When the crankshaft 71 rotates, the inner rotor 114 and the outer rotor 113 are rotated in the pump chamber 112 in operative connection with the rotation of the crankshaft 71. According to variations in the internal volume, the engine oil is sucked into the pump chamber 112 via the suction port 115, and is discharged through the discharge port 117. The engine oil flows from the discharge port 117 through the oil pipe 118 into the second linear oil passage 107. The engine oil flows through the second linear oil passage 107 into the oil filter 53. In the oil filter 53, the engine oil flows from an outer periphery through the filter element to be thereby clarified, and flows into the vertical oil passage 101 in the bracket 54. The engine oil flows through the vertical oil passage 101 and the outlet oil passage 104, and flows into the first connection pipe 55 via the outflow port 59. The engine oil flows through the first port 56*a* of the first joint 56 into the oil cooler 45, to be cooled.

Simultaneously, the engine oil flows into the horizontal oil passage 103 branched from the vertical oil passage 101. The engine oil flows through the horizontal oil passage 103 into the in-shaft oil passage 102 in the balancer shaft 83. The engine oil is supplied from the in-shaft oil passage 102 to the rolling bearing on the eccentric shaft 96. Since cooling is not so required at the balancer shaft 83, the function of the engine oil is sufficiently secured even when the engine oil before cooling is supplied. The engine oil flowing out from the rolling bearing flows into the oil pan 67*c* via the casing 86. Since the bracket 54 protrudes forward from the front wall of the crankcase 33, the engine oil can be air-cooled in the vertical oil passage 101, the horizontal oil passage 103, and the outlet oil passage 104.

The engine oil after cooling flows from the second port 58*a* of the second joint 58 through the second connection pipe 57, and flows into the inlet oil passage 108 via the inflow port 61. The engine oil flows from the inlet oil passage 108 through the first linear oil passage 106 and the main gallery 105, to be supplied to the plain bearings on the basis of each of the partition walls 75. Between the crankshaft 71 and the plain bearings, friction is moderated by the function of the engine oil. The engine oil flowing out from the plain bearings flows into the oil pan 67*c*.

The engine oil branches from the first linear oil passage 106 into the connection oil passage 121. The engine oil flows from the connection oil passage 121 through the apportioning oil passage 122, to be jetted from the piston oil jets 123. In this way, the pistons 63 are lubricated on the basis of each of the cylinders 64. The engine oil having thus contributed to lubrication flows into the oil pan 67*c*.

In the internal combustion engine 31 according to the present embodiment, the bracket 54 formed at the front wall of the crankcase 33 is formed with the mounting surface 52 for receiving the mounting of the oil filter 53 from below. In addition, the outflow port 59 through which the oil flows out toward the oil cooler 45 and the inflow port 61 through which the oil flows in from the oil cooler 45 are disposed in the bracket 54. Since the oil passages interconnecting the crankcase 33 and the oil cooler 45 are concentratedly disposed in the bracket 54, the routes of the oil passages are simplified. At the time of forming the crankcase 33, the number of working steps in processing the oil passages is reduced as much as possible.

Particularly, the bracket 54 has the mounting surface 52 that receives the oil filter 53 attached and detached in the up-down direction, the mounting surface 52 protruding forward from the front wall of the crankcase 33. Interference between the oil filter 53 and the oil cooler 45 is avoided, as compared to the case where the oil filter 53 is attached to and detached from a mounting surface formed at the front wall of the crankcase 33, in the front-rear direction. Maintainability such as replacement of the oil filter 53 is secured to be good.

In the present embodiment, the casing 86 accommodating the eccentric weight 84 and the balancer driven gear 85*a* protrudes from the front wall of the crankcase 33 in parallel to the oil filter 53. Since the oil filter 53 and the casing 86 are arranged in parallel on the front side of the crankcase 33, the internal combustion engine 31 is reduced in size in the front-rear direction.

In the bracket 54 of the crankcase 33, the branch oil passage for supplying the engine oil to the secondary balancer 82 is provided, the branch oil passage branching from the oil passage extending from the oil filter 53 toward the outflow port 59. The supply of the oil to the secondary balancer 82 is realized through a short oil passage from the oil filter 53.

In the present embodiment, the oil cooler 45 is disposed under the radiator 43, and the first port 56*a* communicating with the outflow port 59 and the second port 58*a* communicating with the inflow port 61 are provided between the first horizontal plane Hf making contact with the oil filter 53 from above and the second horizontal plane Hs making contact with the oil filter 53 from below. The first connection pipe 55 and the second connection pipe 57 for interconnecting the crankcase 33 and the oil cooler 45 are shortened as much as possible.

The oil filter 53 is located within the transverse width of the oil cooler 45 as seen in front view, and part of the oil filter 53 is located within the vertical width of the oil cooler 45 as seen in front view. The oil filter 53 is hidden behind the radiator 43 and the oil cooler 45 as seen in front view. As a result, the oil filter 53 is protected from flying stones and the like coming from the front side during traveling of the two-wheeled motor vehicle 11.

The engine oil flow path formed in the crankcase 33 includes: the main gallery 105 that extends in parallel to the rotational axis Rx of the crankshaft 71 and apportions the oil in the crankcase 33; the first linear oil passage 106 that is connected to the inflow port 61 and extends linearly from an outer surface of the bracket 54 to intersect the main gallery 105; and the second linear oil passage 107 that extends linearly in parallel to the first linear oil passage 106 and opens into the oil filter 53. Since the first linear oil passage 106 and the second linear oil passage 107 are concentratedly disposed in the periphery of the oil filter 53, a processing work is made efficient and productivity is enhanced. Especially, since the first linear oil passage 106 and the second linear oil passage 107 extend in parallel to each other, the processing work can be realized from the same direction, and the working process is made more efficient.

What is claimed is:

1. An internal combustion engine comprising: a crankcase; an oil filter that is mounted to a mounting surface formed on the crankcase and clarifies an oil flowing in; and an oil cooler that is disposed on a front side of the crankcase, cools the oil flowing in from the oil filter and returns the oil into a flow path in the crankcase, wherein the internal combustion engine further comprises a bracket formed on a front wall of the crankcase and having the mounting surface, an outflow port through which the oil flows out toward the oil cooler and an inflow port through which the oil flows in from the oil cooler are disposed in the bracket, wherein the bracket has a mounting surface receiving the oil filter that protrudes forward from the front wall of the crankcase, the oil filter being attached and detached in an up-down direction, and the oil cooler is disposed under a radiator, and has a first port communicating with the outflow port and a second port communicating with the inflow port, at least one of the first and second ports being between a first horizontal plane making contact with the oil filter from above and a second horizontal plane making contact with the oil filter from below.

2. The internal combustion engine according to claim 1, further comprising a casing that is formed at the front wall of the crankcase and accommodates a balancer operatively connected with rotation of a crankshaft, and the casing protrudes from the front wall of the crankcase in parallel to the oil filter.

3. The internal combustion engine according to claim 2, wherein the crankcase is provided with a branch oil passage that is branched from an oil passage extending from the oil filter toward the outflow port, the branch oil passage supplying the oil to the balancer.

4. The internal combustion engine according to claim 1, wherein the oil filter is located within a transverse width of the oil cooler as seen in front view, and part of the oil filter is located within an up-down width of the oil cooler as seen in front view.

5. The internal combustion engine according to claim 1, wherein the flow path includes:

a main gallery that extends in parallel to a rotational axis of a crankshaft and apportions the oil in the crankcase;

a first linear oil passage that is connected to the inflow port and extends linearly from an outer surface of the bracket to intersect the main gallery; and a second linear oil passage that is connected to an oil pump, extends linearly in parallel to the first linear oil passage, and opens into the oil filter.

* * * * *